US006219844B1

(12) United States Patent
Yamada et al.

(10) Patent No.: US 6,219,844 B1
(45) Date of Patent: Apr. 24, 2001

(54) BASEBALL GLOVE AND PALM MEMBER THEREFOR

(75) Inventors: Minoru Yamada; Kazuhiro Kume, both of Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 09/366,719

(22) Filed: Aug. 4, 1999

(30) Foreign Application Priority Data

Aug. 4, 1998 (JP) ..... 10-233549
Jul. 14, 1999 (JP) ..... 11-200200

(51) Int. Cl.[7] ..... A41D 13/08
(52) U.S. Cl. ..... 2/19
(58) Field of Search ..... 2/19, 159, 161.1, 2/169; 473/458

(56) References Cited

U.S. PATENT DOCUMENTS 5,012,529 5/1991 Murai .
5,167,038 * 12/1992 Rinehart ..... 2/169
5,740,555 * 4/1998 Renegar ..... 2/161.1

* cited by examiner

*Primary Examiner*—John J. Calvert
*Assistant Examiner*—Gary L. Welch
(74) *Attorney, Agent, or Firm*—McDermott, Will & Emery

(57) ABSTRACT

In a pattern used to manufacture a palm member for a baseball glove, the central lines of all the thumb and finger portions cross on a ball receiving surface. A palm member is formed by cutting a material based on pattern and the palm member and a back member are combined to manufacture a baseball glove.

11 Claims, 13 Drawing Sheets

BASEBALL GLOVE AND PALM MEMBER THEREFOR

BACKGROUND OF THE INVENTION

1. Field of the Invention

The present invention relates to improvements in a baseball glove (hereinafter simply as glove) and a palm member used to manufacture the glove.

2. Description of the Background Art

A player cannot have a good feel when he/she puts on a conventional glove when the glove is new. Therefore, the player must bend the entire finger portion a number of times or repeat playing catch to form a pocket portion (space to hold a ball) until the glove comes to fit the hand well enough for the player to stably catch a ball.

An example of a pattern 2*a* used for manufacturing a conventional glove will be now described. In conventional pattern 2*a*, as shown in FIG. 10 for example, the central line 81 of a thumb portion 31*a* and the central line 82 of an index finger portion 32*a* cross at an angle of not less than 90° and the crossing point is positioned on a ball receiving surface 4*a*, but out of the center and near the knuckle parts of thumb portion 31*a* and index finger portion 32*a*.

The central line 81 of thumb portion 31*a* and the central line 82 of index finger portion 32*a* cross at an angle of not less than 90°, and therefore, the crossing angles of the central lines 82 to 85 between index finger portion 32*a* and a middle finger portion 33*a*, middle finger portion 33*a* and a third finger portion 34*a*, and third finger portion 34*a* and a little finger portion 35*a* are small. As a result, central lines 82 to 85 cross at positions apart from ball receiving surface 4*a*.

A glove manufactured using this type of pattern 2*a* is adapted to hold a ball between the thumb portion and the other finger portions rather than capture it on the ball receiving surface. Such a glove does not enable good catching in the early stage of use as it is new, and therefore the glove is for example intentionally deformed as follows before use. More specifically, the glove is bend a number of times as if it holds a ball or catching is repeated with the glove in order to curve the glove inward. Thus, the pocket portion is created in the glove, which makes it easier to catch a ball.

FIGS. 11 to 13 are views of a conventional glove 1 after a pocket portion 7 is formed by way of illustration. As shown in FIGS. 11 and 12, pocket portion 7 is positioned on ball receiving surface 4 but near the web 6 provided between the thumb stall and the index finger stall. If glove 1 is used to catch a ball, the ball will be caught at a position near the web 6 rather than the center of ball receiving surface 4. As shown in FIG. 13, when glove 1 is used to catch a grounder, the gap between the third finger stall or little finger stall and ground 9 will be large. This also causes a ball to be caught at a position near the web 6.

Meanwhile, when a player is to catch a baseball with his/her bare hands, the most natural and balanced catching is performed when the ball is captured by the central part of the palm portion.

With conventional glove 1 as shown in FIGS. 11 to 13, however, pocket portion 7 is positioned near the web 6, and it is difficult to catch a ball at the central portion of the palm. In other word, it is difficult to catch a ball in a stable and well-balanced manner.

SUMMARY OF THE INVENTION

The present invention is directed to a solution to the above described disadvantage, and it is an object of the present invention is to provide a glove in which a pocket portion is positioned in the center of the ball receiving surface and which enables a ball to be caught in a sure and stable manner by the center of the ball receiving surface as if it were captured by bare hands, and a palm member used to manufacture the glove.

A glove according to the present invention includes a palm member having a plurality of finger portions (thumb and finger portions), and a ball receiving surface. The central lines of all the thumb and finger portions cross on the ball receiving surface. Herein, the central line refers to the central line of a finger (thumb) portion in the lengthwise direction.

The inventors have devoted much energy to the study of how to position the pocket portion of a glove in the center of the ball receiving surface, and found that if the position of the crossing points of the central lines of the finger (thumb) portions were related to the position of the pocket portion. More specifically, the inventors found that the pocket portion could be formed in the center of the ball receiving surface by positioning the crossing points of the central lines of the finger (thumb) portions of the palm member on the ball receiving surface of the palm member. By thus positioning the pocket portion in the center of the ball receiving surface, a ball can be surely captured at the center of the palm as if it is caught by a bare hand. Furthermore, the glove can be smoothly moved to catch a ball in conformity with the natural movement of the hand as the player grasps a ball in a bare hand. More specifically, the natural movement of the hand to catch a ball and the movement of the glove can be integrated. Thus, well balanced, stable catching can be achieved. In addition, as shown in FIG. 1, pocket portion 7 can be larger than the conventional example. This could also contribute to stable catching.

The above-described central lines preferably cross at a single point on the ball receiving surface.

Since the central lines cross at a single point, a glove which can be moved more smoothly at the time of catching a ball is provided. Furthermore, the pocket portion could be formed in the center of the ball receiving surface with higher accuracy.

The central lines described above may cross near the center of the ball receiving surface.

Also in this case, the pocket portion can be positioned in the center of the ball receiving surface with higher accuracy. As a result, a ball can be surely captured in the central part of the palm portion, and the glove can more readily cope with a ball coming from various directions.

The palm member has a thumb portion, an index finger portion, a middle finger portion, a third finger portion and a little finger portion. The central line of the thumb portion and the central line of the index finger portion preferably cross at an angle in the range from 85° to 105°. The central lines of the index finger portion and the middle finger portion, the central lines of middle finger portion and third finger portion and the central lines of the third finger portion and little finger portion preferably cross at an angle in the range from 15° to 25°.

The inventors found that all the central lines could cross on the ball receiving surface by setting the crossing angles of the central lines of the finger (thumb) portions in the above-described ranges.

The angle at which the central lines of the index finger portion and middle finger portion cross and the angle at which the central lines of the middle finger portion and third finger portion cross is preferably smaller than the angle at which the central lines of the third finger portion and little finger portion cross.

Thus, the crossing points of the central lines of the thumb and finger portions can be positioned near the center of the ball receiving surface.

The angle at which the central lines of the thumb portion and index finger portion cross is preferably 90°. The angle at which the central lines of the index finger portion and middle finger portion cross and the angle at which the central lines of the middle finger portion and third finger portion cross are both preferably 20°. The angle at which the central lines of the third finger and little finger portion cross is preferably 25°.

If the central lines are set to cross at the above angles, the central lines of the thumb and finger portions can cross at a single point on the ball receiving surface.

The glove described above has a pocket portion to capture a ball. The pocket portion is preferably positioned substantially in the center of the ball receiving surface.

By thus providing the pocket portion in the center of the ball receiving surface, a ball can be captured by the center of the palm portion, so that sure and stable catching can be achieved.

The pocket portion described above preferably extends from a position near the knuckle of the thumb stall to a position near the knuckle of the little finger stall.

With the palm member having the above described shape, not only the pocket portion can be positioned substantially in the center of the ball receiving surface, but also the pocket portion can be expanded. More specifically, for example as shown in FIGS. 1 and 2, pocket portion 7 can be formed extending from the vicinity of the knuckle of the thumb stall to the vicinity of the knuckle of the little finger stall, so that sure and stable catching can be achieved.

The palm member according to the present invention is used to form the ball receiving surface of a glove. The palm member has a plurality of finger portions (thumb and finger portions), and all the central lines of the finger portions cross on the ball receiving surface.

A glove manufactured with such a palm member has the various advantages as described above and a pocket portion easy to use from the beginning is provided, so that a glove which can be immediately used in a game from the moment it is taken out from the package is provided.

The central lines described above preferably cross at a single point on the ball receiving surface. The central lines may cross in the vicinity of the center of the ball receiving surface.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

The present invention is made to provide a glove which enables a ball to be caught in a sure and stable manner in the center of the palm portion as if it were captured by a bare hand.

Figure 9:
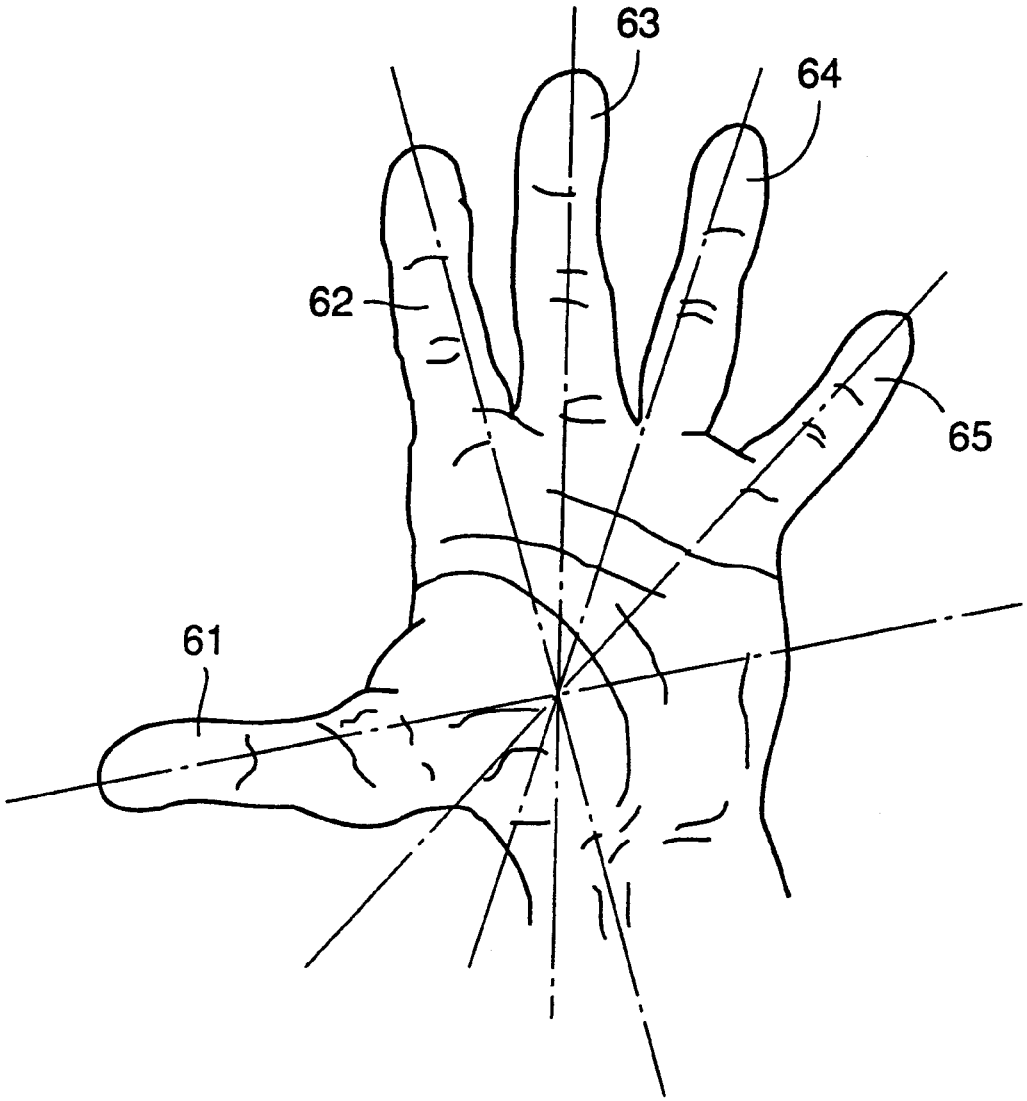
FIG. 9 is a view of a bare hand in a natural state to capture a baseball.
Figure 10:
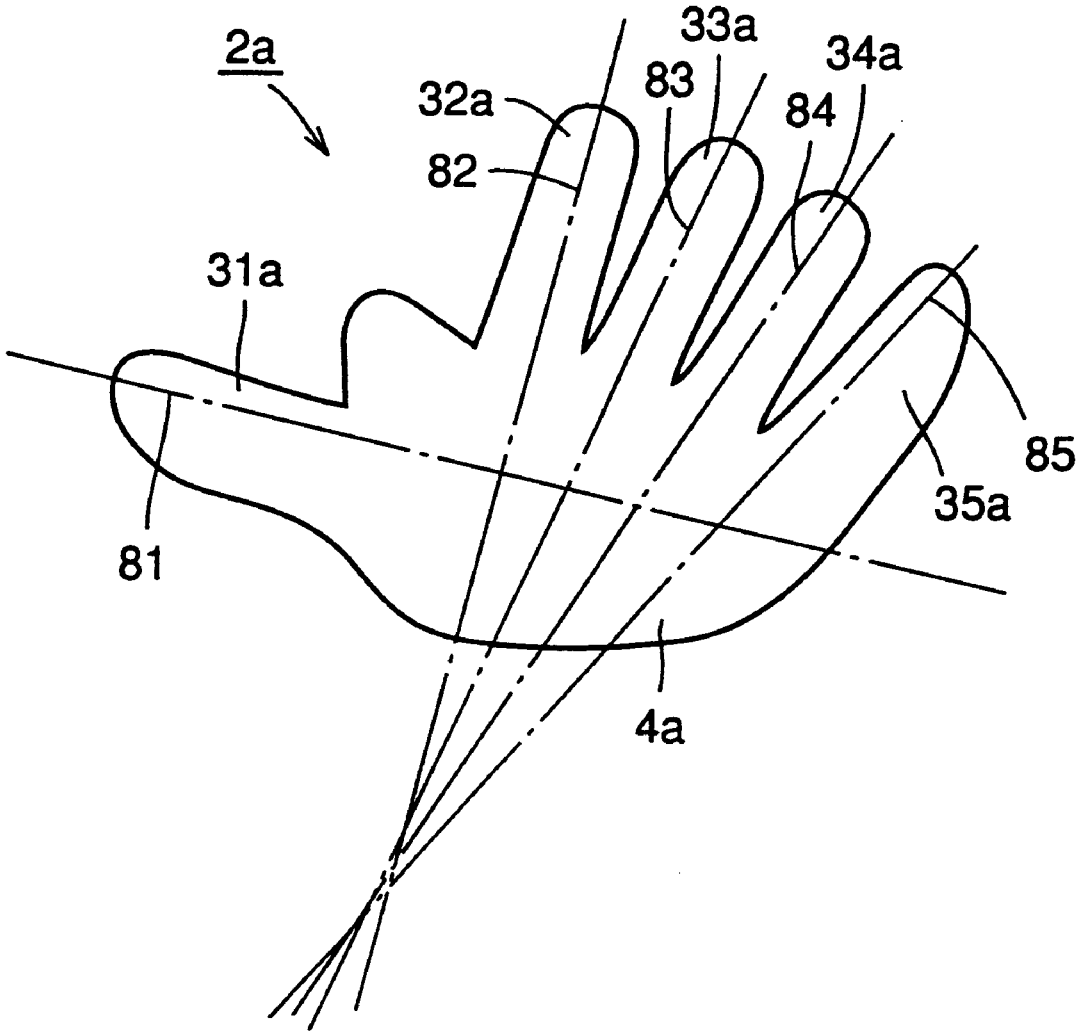
FIG. 10 PRIOR ART
FIG. 10 is a plan view of a pattern used to manufacture a conventional palm member.
Figure 11:
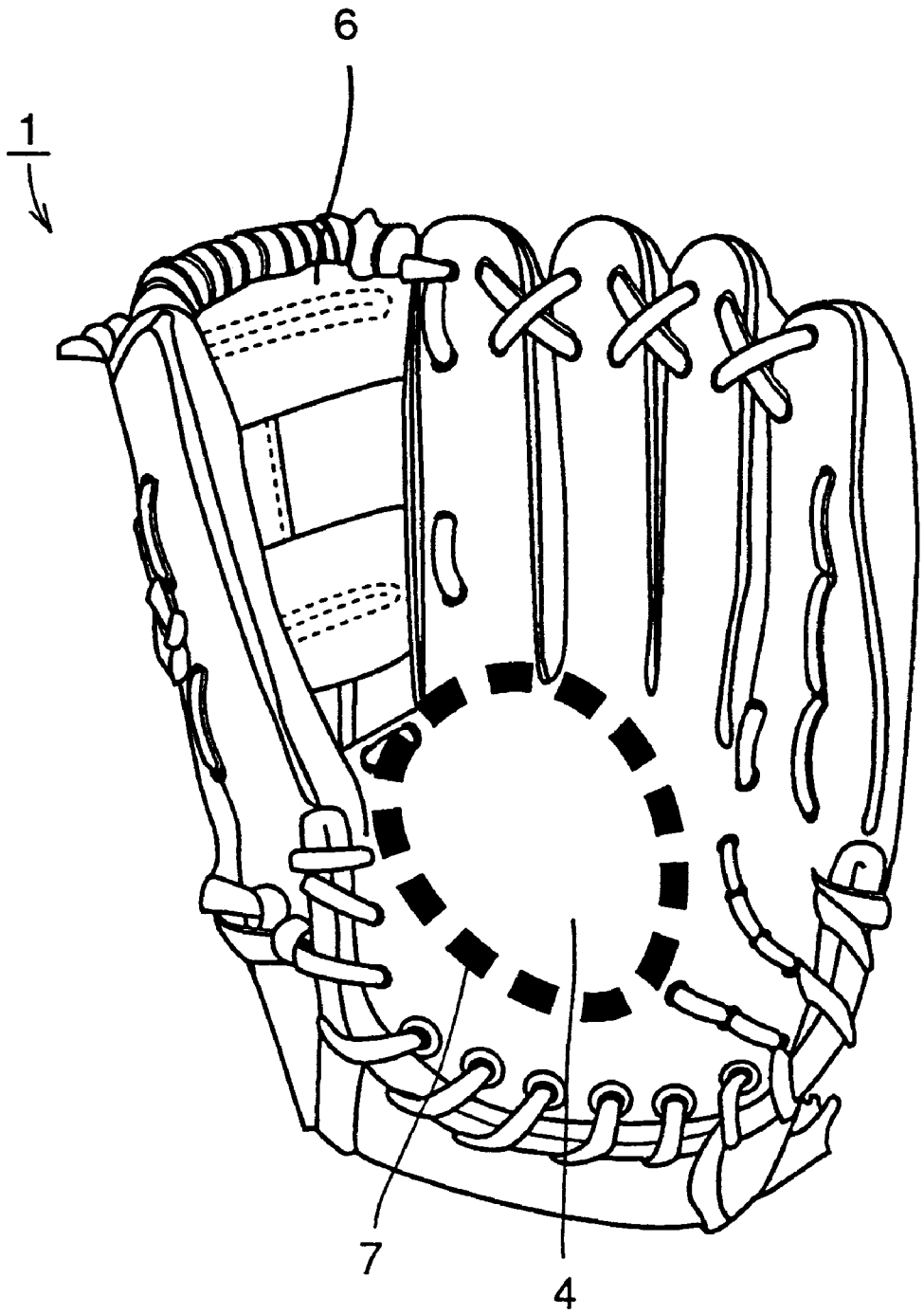
FIG. 11 PRIOR ART
FIG. 11 is a front view of a glove manufactured using a conventional palm member.
Figure 12:
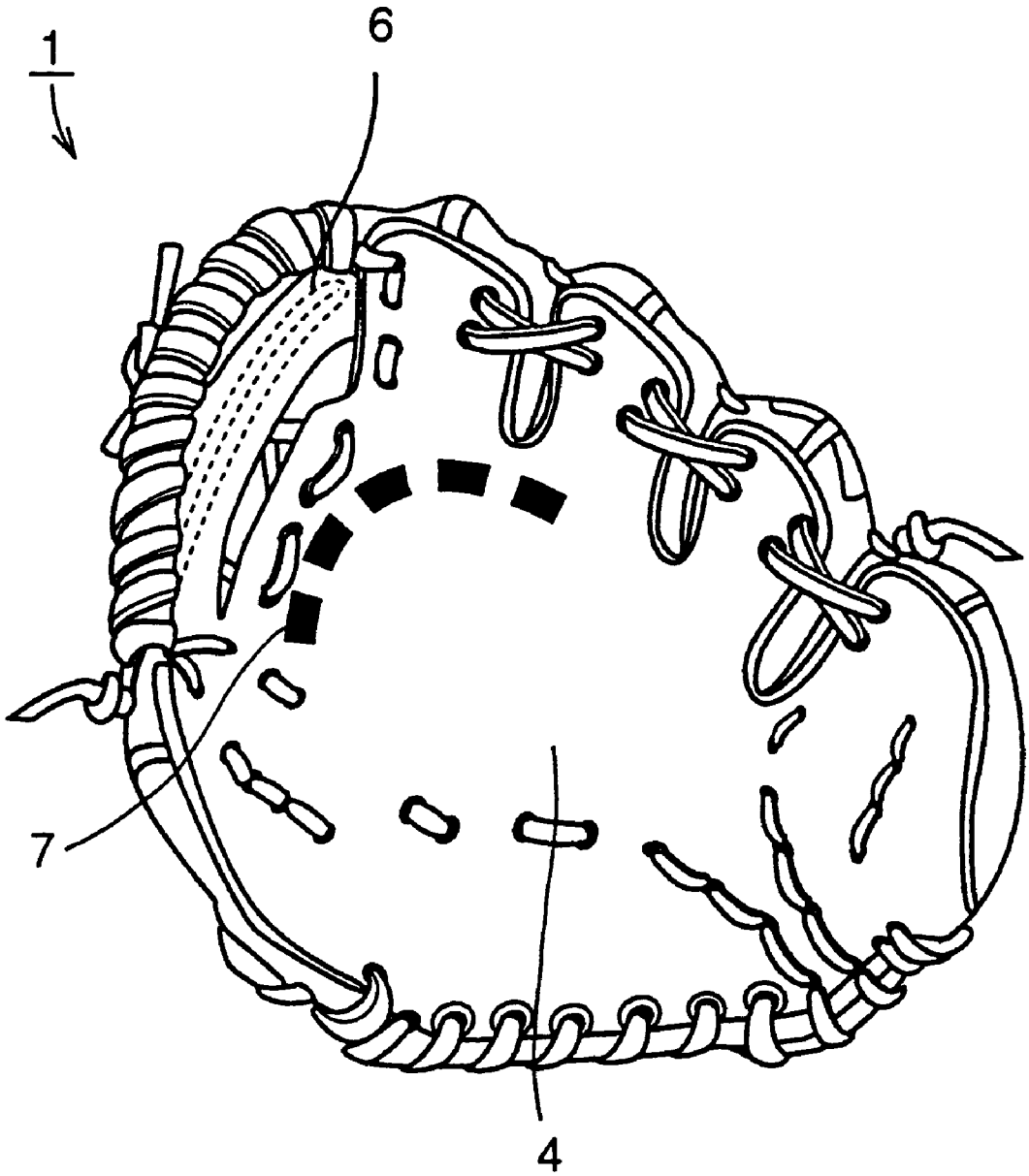
FIG. 12 PRIOR ART
FIG. 12 is a plan view of the glove shown in FIG. 11.
Figure 13:
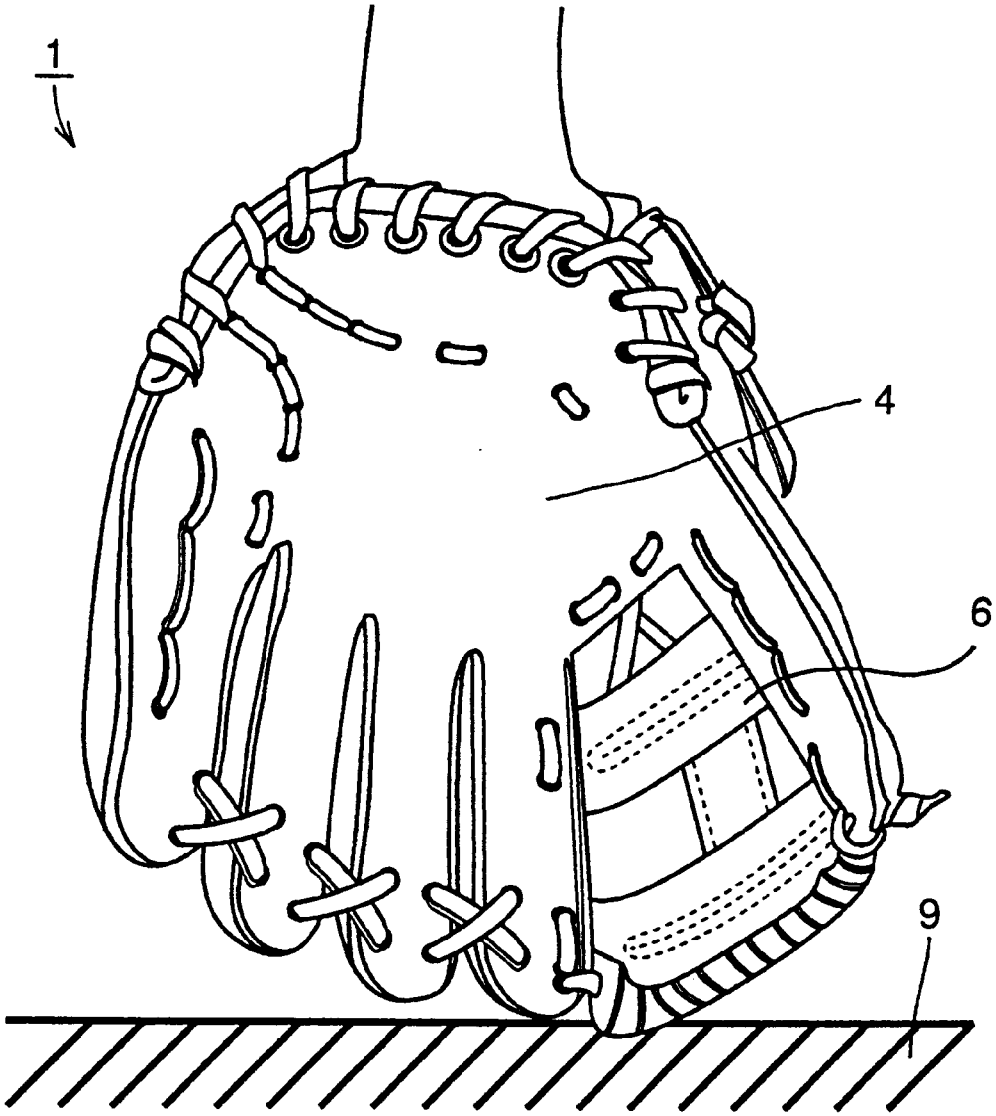
FIG. 13 PRIOR ART
FIG. 13 is a view showing how a grounder is captured using the glove shown in FIG. 11.

In order to provide such a glove, the inventors analyzed the movement of a bare hand when a player captures a ball with the hand. FIG. 9 shows the state of a bare hand when a player tries to capture a baseball with the hand. When a player tries to catch a ball with a bare hand, the thumb and four fingers 61 to 65 are outspread to be ready for the catch, the ball is captured by the palm and then the thumb and fingers 61 to 65 are bent inward to hold the ball.

At this time, as shown in FIG. 9, the central lines of thumb and fingers 61 to 65 are substantially gathered at a single point almost in the center of the palm. More specifically, the pocket portion is positioned in the center of the palm. More specifically, the central lines of thumb 61 and index finger 62 cross at an angle of about 90°, the central lines of index finger 62 and middle finger 63, the central lines of middle finger 63 and third finger 64, and the central lines of third finger 64 and little finger 65 cross at angles in the range from 15° to 25°. If the central lines of thumb and fingers 61 to 65 cross in the vicinity of the center of the palm if not at a single point, the position of the pocket is assumed to be in the vicinity of the center of the palm.

The inventors have studied in order to reflect the finding upon the manufacture of a glove, and invented the way of reflecting the content described above upon the shape of the member forming the palm of the glove (palm member). More specifically, the central line of all the thumb and fingers along the lengthwise direction are allowed to cross on the ball receiving surface of the palm member. A glove manufactured using such a palm member has a pocket portion in the center of the ball receiving surface, so that a ball can be captured by the central portion of the palm. In addition, the glove and the hand wearing the glove can be moved integrally as if a ball were captured in a bare hand.

Hereinafter, referring to FIGS. 1 to 8, a glove according to the present invention, a palm member used to manufacture the glove, and a specific example of a pattern used to form the palm member will be described.

Figure 4:
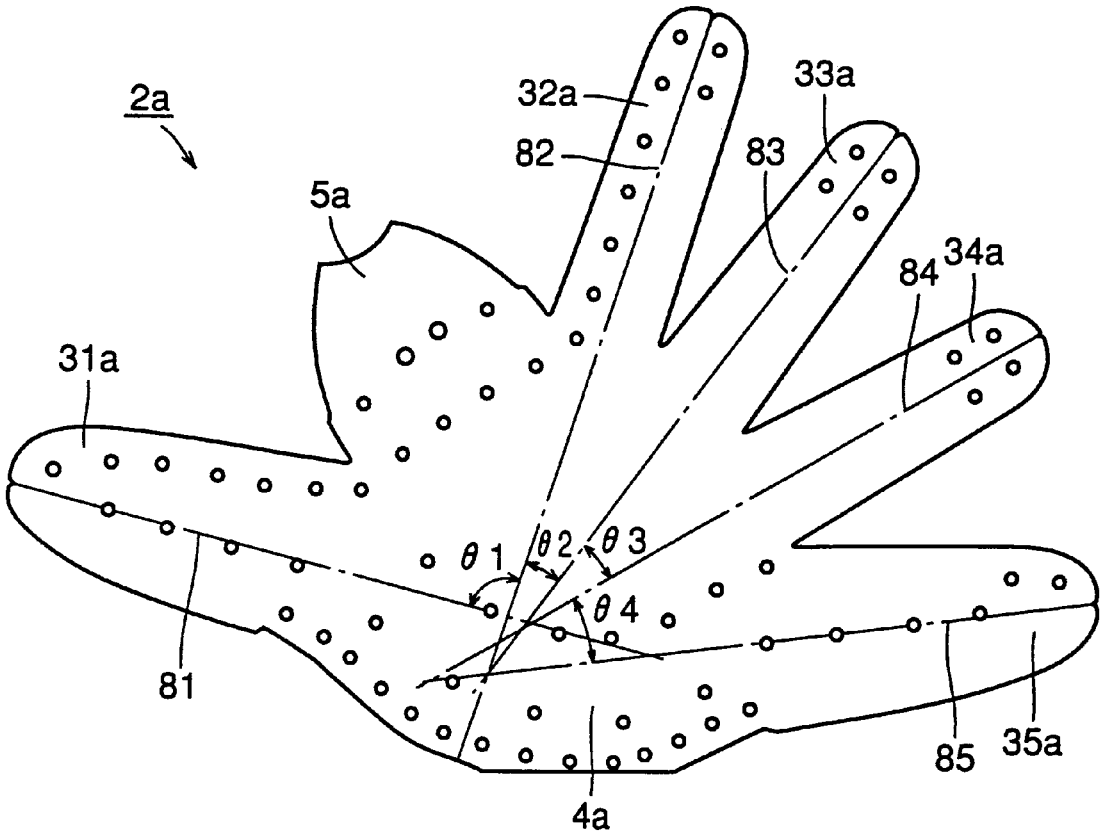
FIG. 4 is a plan view of a pattern used to manufacture a palm member according to the present invention.
Figure 5:
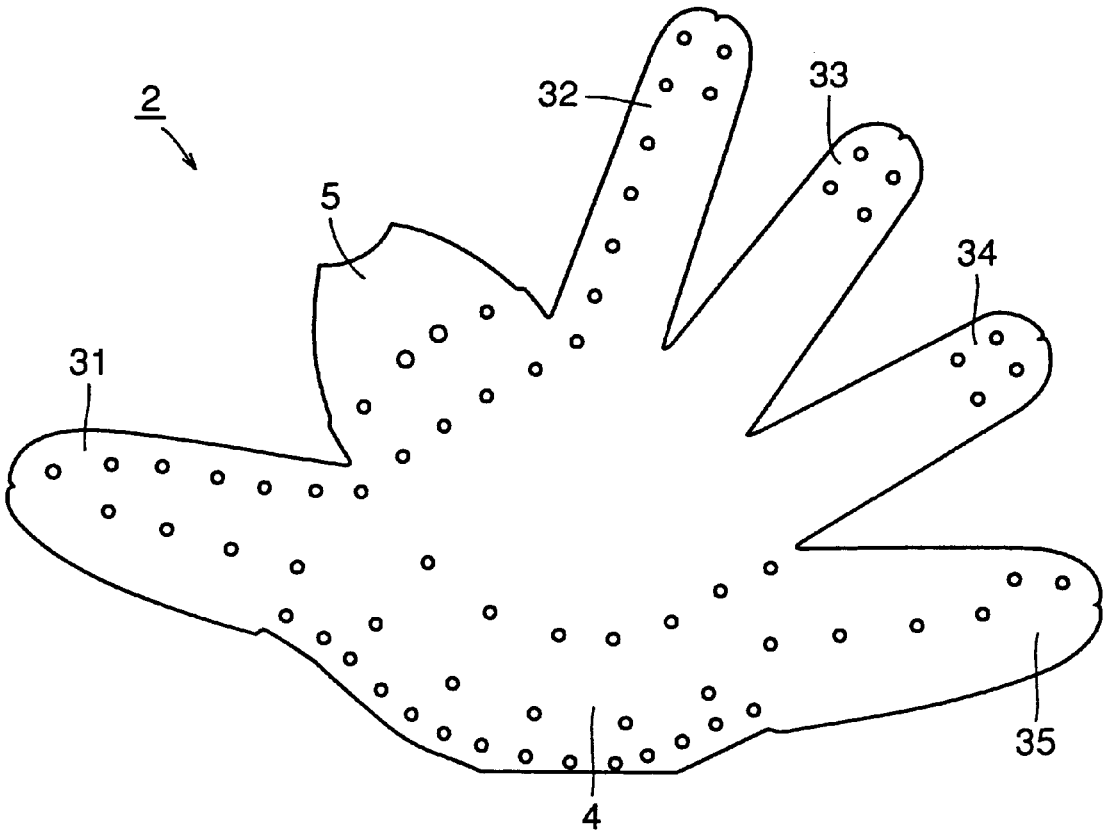
FIG. 5 is a view (plan view) of the palm portion of a glove according to the present invention as it is spread out.

Referring to FIGS. 4 and 5, a pattern 2*a* for a pitcher glove and the shape of palm portion 2 (palm member) in a spread form will be described by way of illustration. FIG. 4 is a view of pattern 2*a* used to manufacture palm member 2.

Pattern 2*a* is manufactured taking into consideration with the angles formed between the thumb and fingers when a player is to catch a base ball in a bare hand. As shown in FIG. 4, pattern 2*a* has a thumb portion 31*a*, an index finger portion 32*a*, a middle finger portion 33*a*, a third finger portion 34*a*, a little finger portion 35*a* and a web portion 5*a*. The central lines 81 to 85 of thumb and finger portions 31*a* to 35*a* cross on a ball receiving surface 4*a*.

The central line 81 of thumb portion 31*a* and the central line 82 of index finger portion 32*a* cross at an angle θ1 in the range from 85° to 105°. The angle θ2 at which the central lines 82 and 83 of index finger portion 32*a* and middle finger portion 33*a* cross, the angle θ3 at which the central lines 83 and 84 of middle finger portion 33*a* and third finger portion 34*a* cross, and the angle θ4 at which the central lines 84 and 85 of third finger portion 34*a* and little finger portion 35*a* cross are all in the range from 15° to 25°.

Palm portion 2 manufactured by cutting a material based on pattern 2*a* is shown in a spread form in FIG. 5 (a view of the palm member). As shown, palm portion (palm member) 2 is in substantially the same shape as pattern 2*a*, and has a ball receiving surface portion 4, a thumb portion 31, an index finger portion 32, a middle finger portion 33, a third finger portion 34, a little finger portion 35 and a web portion 5. This palm portion 2 and a back portion (including a plurality of parts) manufactured by a different method are combined to form a glove.

A glove manufactured with the palm member having the shape described above has a pocket portion in the center of ball receiving surface 4 and the state of the glove put on a hand is like the state of a bare hand immediately before a player captures a ball with the hand. Thus, a ball can be caught by the central part of the palm and the glove can smoothly follow the natural movement of the hand.

Figure 1:
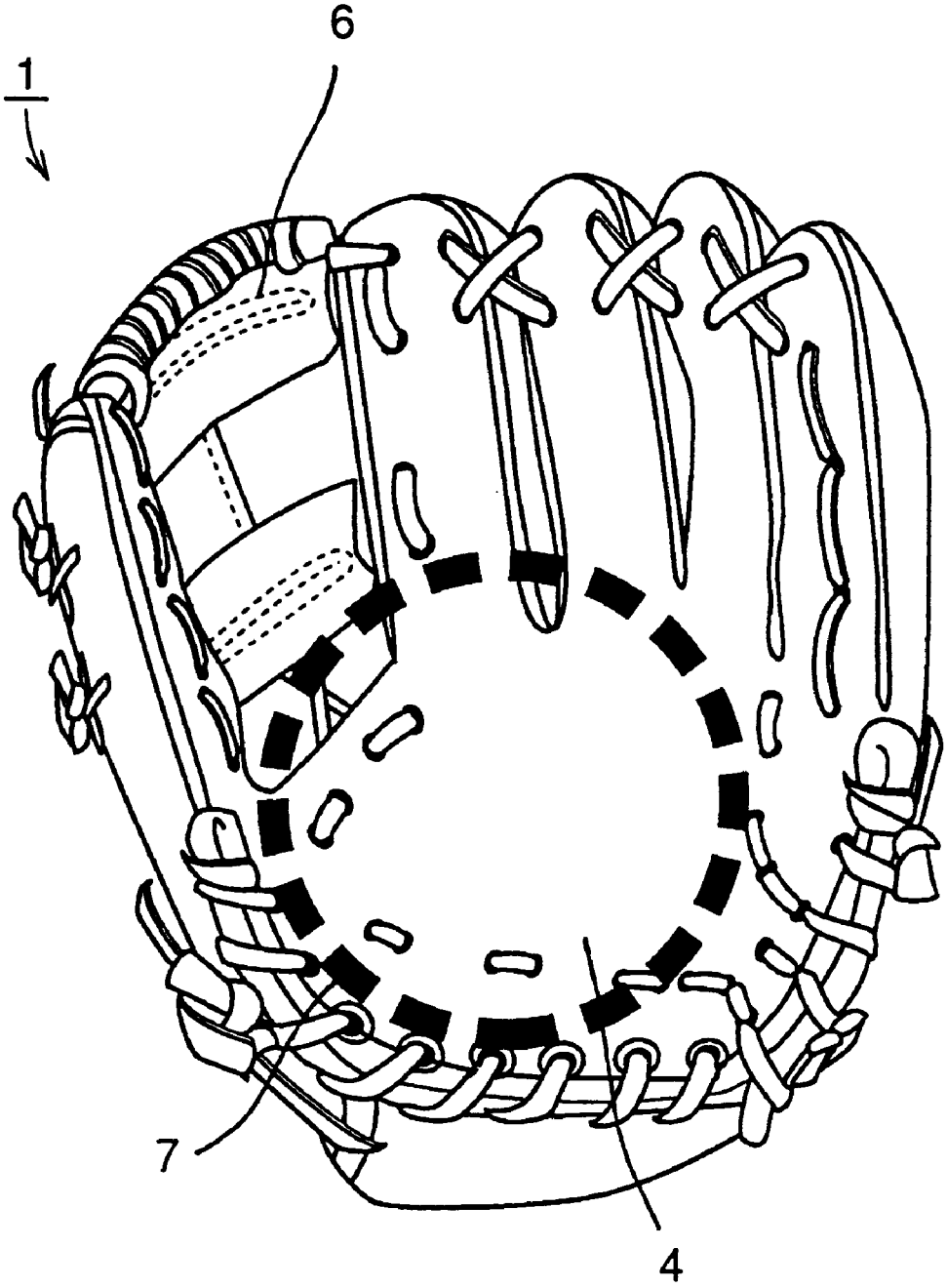
FIG. 1 is a front view of a glove manufactured using a palm member according to the present invention.
Figure 2:
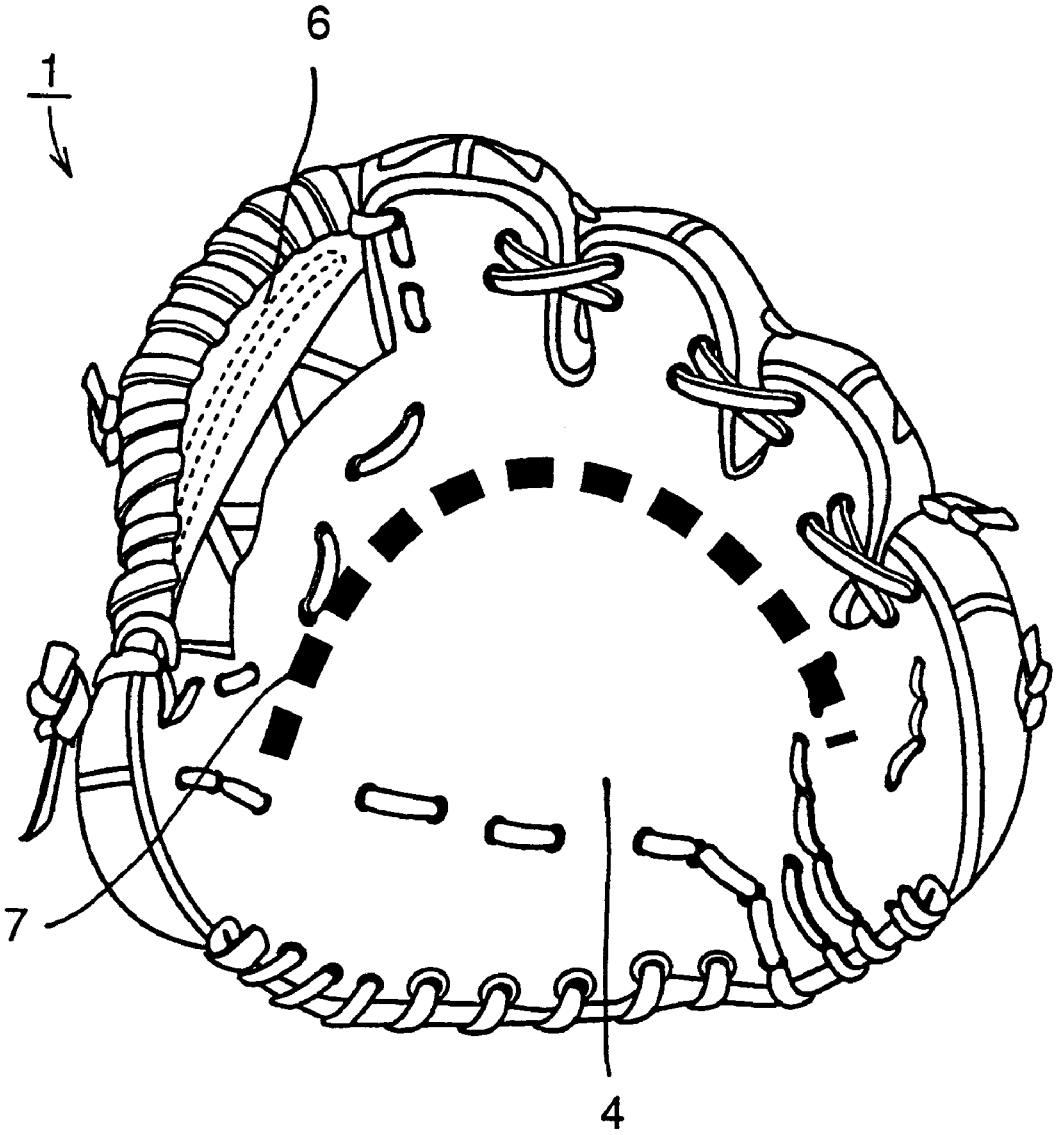
FIG. 2 is a plan view of the glove shown in FIG. 1.
Figure 3:
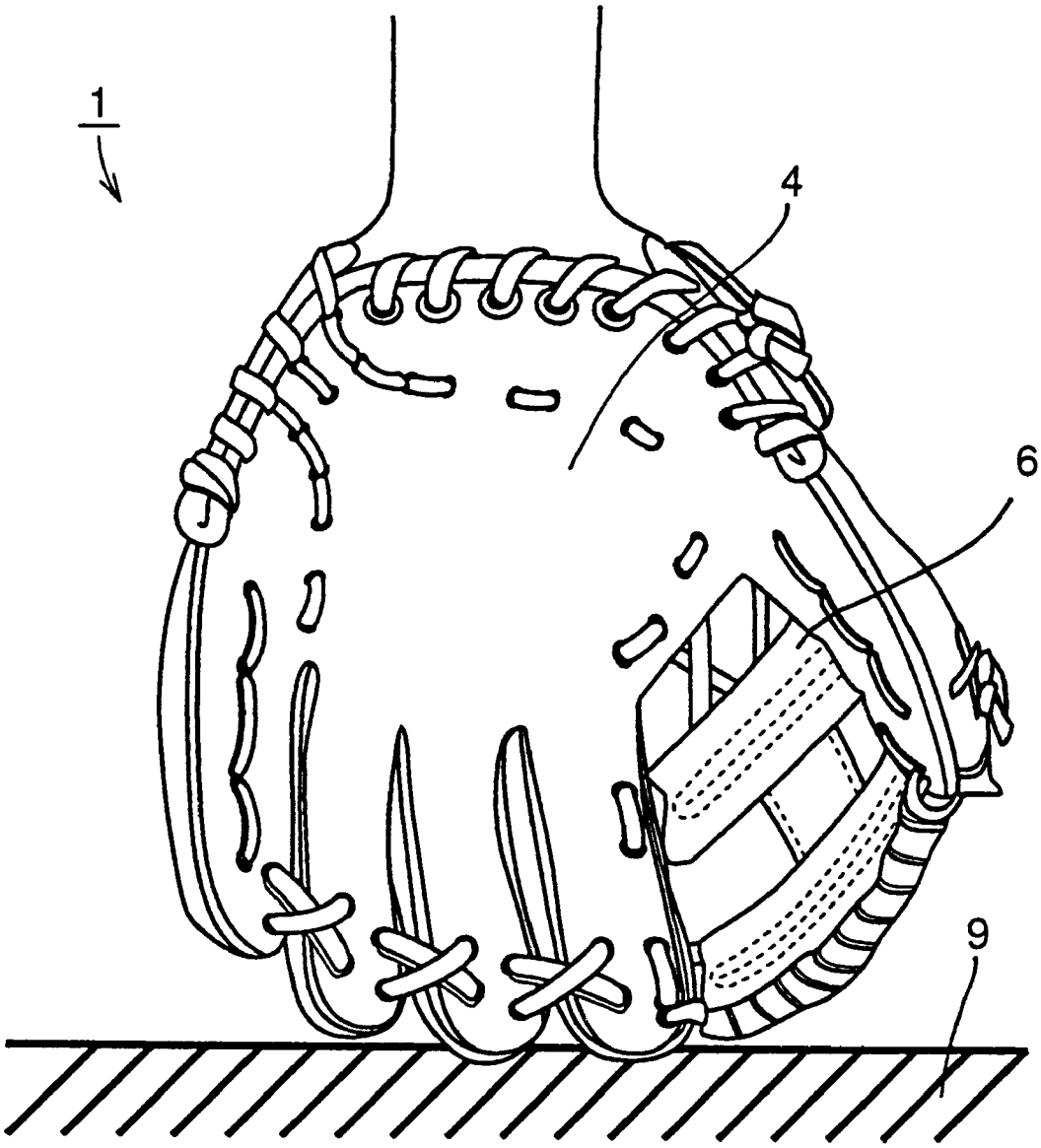
FIG. 3 is a view showing how a grounder is captured using the glove shown in FIG. 1.

FIGS. 1 to 3 show an example of glove 1 manufactured using the palm member shown in FIG. 5. As shown, a glove manufactured using the palm member described above has a pocket portion 7 positioned substantially in the center of ball receiving surface 4.

In addition, pocket portion 7 extends from the vicinity of the knuckle of the thumb stall of glove 1 to the vicinity of the knuckle of the little finger stall, in other words pocket portion 7 is larger than the conventional example. Thus, the glove can cope with a ball coming from various directions.

Furthermore, glove 1 manufactured with the palm member described above is a relatively spread glove and desired pocket portion 7 is formed in the early stage of the manufacture as shown in FIG. 1. Thus, it is not need to bend glove 1 to form pocket portion 7.

Furthermore, since glove 1 has a relatively spread shape as described, the gap between glove 1 and ground 9 can be reduced when glove 1 is used to catch a grounder, which allows a player to surely and readily capture a grounder.

Glove 1 has a rounder shape as the angles formed between the thumb and fingers 31 to 35 are greater, and the position of pocket portion 7 moves back side accordingly. Therefore, glove 1 which allows easier catching results is obtained. If however the angles are too large, ball receiving surface 4 is likely to have wrinkles. Therefore, the angles θ1 to θ4 between the central lines of thumb and finger portions 31 to 35 are set in the ranges described above. Thus, wrinkles on ball receiving surface 4 can be effectively restrained.

Figure 6:
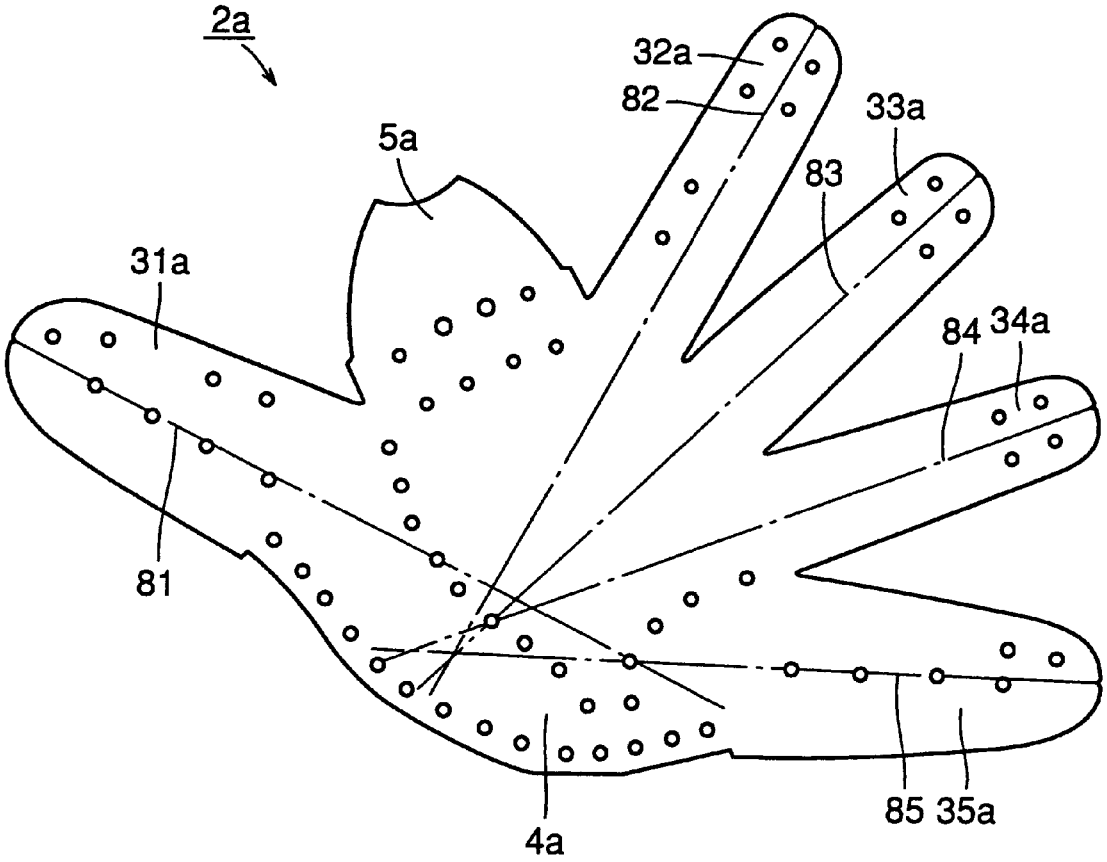
FIG. 6 is a plan view of a pattern used to manufacture a glove for outfielder.
Figure 7:
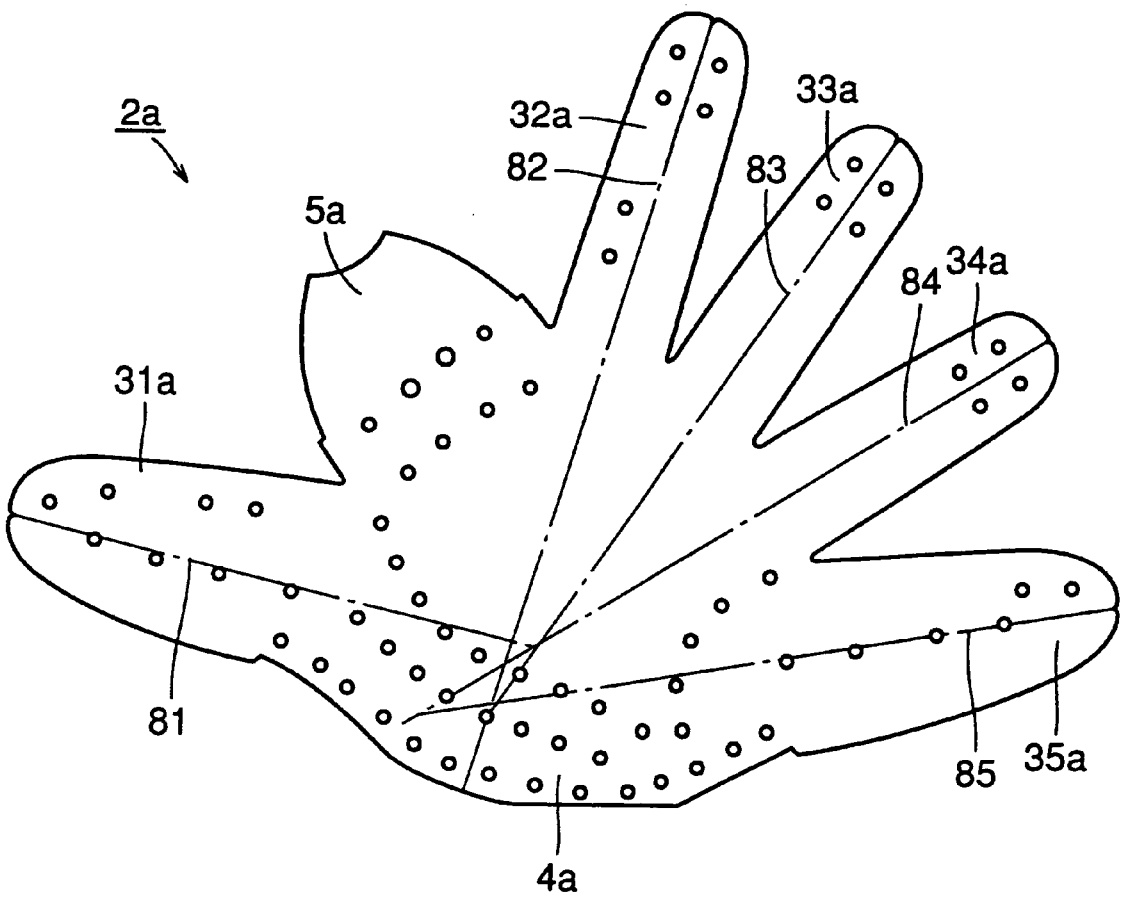
FIG. 7 is a plan view of a pattern used to manufacture a glove for infielder.

The above described idea is applicable to pattern 2*a* used to form outfielder and infielder gloves as shown in FIGS. 6 and 7. The same effects as the pitcher glove are expected.

Figure 8:
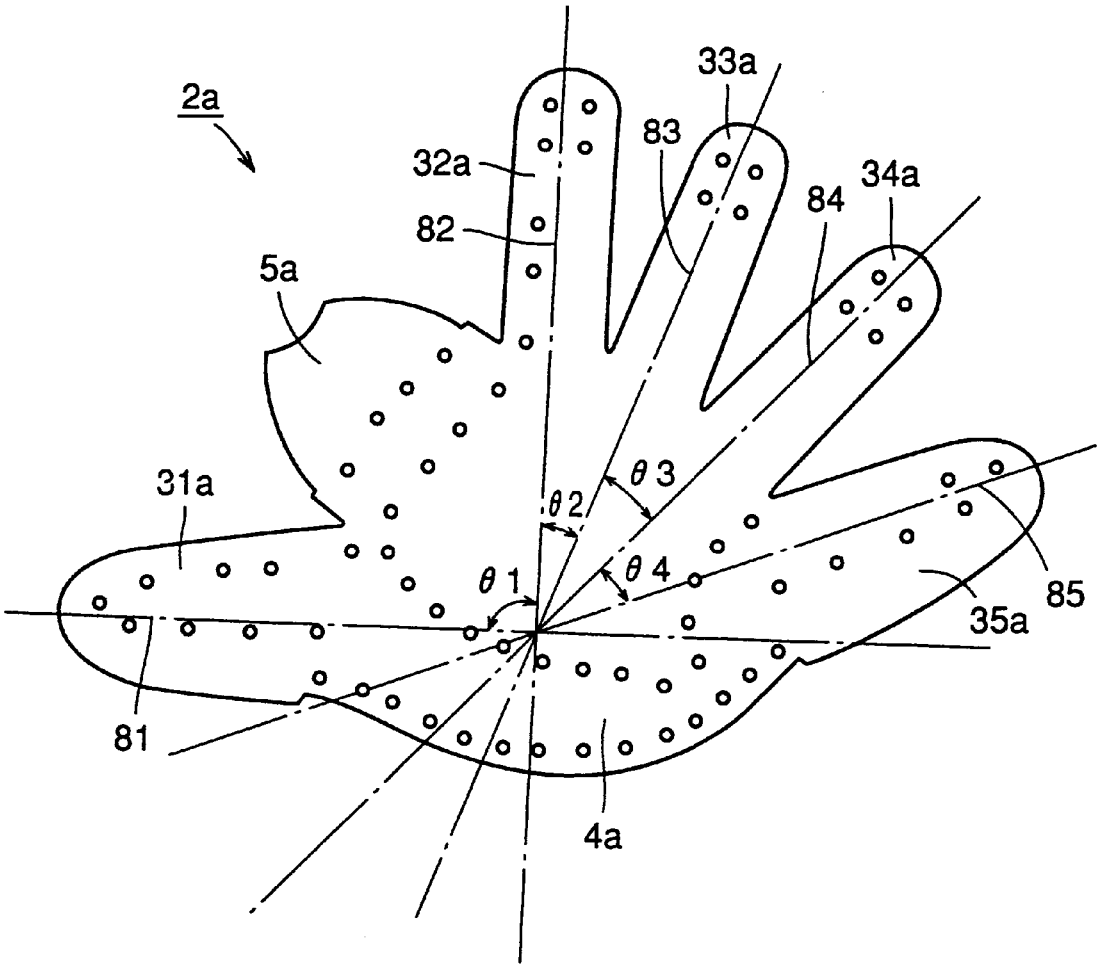
FIG. 8 is a plan view of a variation of the pattern shown in FIG. 4.

As shown in FIG. 8, angles θ1 to θ4 at which central lines 81 to 85 of thumb and finger portions 31*a* to 35*a* cross may be changed for example based on the shape of web portion 5*a* integrally formed between thumb portion 31*a* and index finger portion 32*a*.

Adjusting angles θ1 to θ4 by appropriately changing the shape of web portion 5*a* allows central lines 81 to 85 to cross at a single point on ball receiving portion 4*a*. More specifically, central lines 81 to 85 can cross at a single point as shown in FIG. 8 when angle θ1 is 90°, angles θ2 and θ3 are 20° and angle θ4 is 25°.

Herein, angle θ4 is set greater than angles θ2 and θ3. When angle θ4 is thus relatively large, the crossing point of central lines 81 to 85 of thumb and finger portions 31*a* to 35*a* may be positioned near the center of ball receiving surface 4.

Note that although the embodiments of a glove for left hand are described, the invention is applicable to a glove for right hand. The material of glove 1 is preferably natural leather or mainly of non-elastic material such as artificial leather.

As in the foregoing, according to the present invention, a glove which can be moved smoothly following the natural movement of fingers when a player captures a ball in a bare hand is provided. As a result, the movement of the hand and the movement of the glove can be matched so that stable catching can be achieved.

Furthermore, the pocket portion of the glove is positioned in the center of the ball receiving surface, and the pocket portion can be larger than the conventional example. As a result, a ball can be captured by the central part of the palm, and the glove can more easily cope with a ball coming from various directions.

Furthermore, a glove manufactured with a palm member according to the present invention has a desired pocket portion from the beginning of the use. Thus, the glove does not have to be deformed to form a pocket portion and can be used immediately in a game as it is new.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A baseball glove comprising:

a palm member having a thumb portion, a plurality of finger portions, and a ball-receiving surface, a web portion disposed between said thumb portion and said plurality of finger portions, and a web lacing for attaching said web portion to said thumb portion and said plurality of finger portions, wherein central lines of all said finger portions cross on said ball-receiving surface, a central line of said thumb portion crosses the central lines of all said finger portions on said ball-receiving surface, and the central line of the thumb portion and the central line of an index finger portion cross at an angle ranging from 85°–105°.

2. The baseball glove according to claim 1, wherein the central line of said thumb portion crosses the central lines of said finger portions at a single point on said ball-receiving surface.

3. The baseball glove according to claim 1, wherein the central lines of said finger portions cross in the vicinity of the center of said ball receiving surface, and the central line of said thumb portion crosses the central line of said finger portions in the vicinity of the center of said ball receiving surface.

4. The baseball glove according to claim 1, wherein:

said plurality of finger portions comprises an index finger portion, a middle finger portion, a third finger portion, and a little finger portion, and the central lines of said index finger portion and said middle finger portion, the central lines of said middle finger portion and said third finger portion, and the central lines of said third finger portion and said little finger portion cross at an angle in the range of 15° to 25°.

5. The baseball glove according to claim 4, wherein the angle at which the central lines of said index finger portion and said middle finger portion cross and the angle at which the central lines of said middle finger portion and said third finger portion cross are smaller than the angle at which the central lines of said third finger portion and said little finger portion cross.

6. The baseball glove according to claim 5, wherein the angle at which the central lines of said thumb portion and said index finger portion cross is about 90°, the angle at which the central lines of said index finger portion and said middle finger portion cross and the angle at which the central lines of said middle finger portion and said third finger portion cross are about 20°, and the angle at which the central lines of said third finger portion and said little finger portion cross is about 25°.

7. The baseball glove according to claim 1, further comprising a pocket portion to capture a ball, said pocket portion being positioned substantially in the center of said ball receiving surface.

8. The baseball glove according to claim 7, wherein said pocket portion extends from the vicinity of a knuckle of a thumb stall to the vicinity of a knuckle of a little finger stall.

9. A palm member for a baseball glove used to form a ball-receiving surface of the baseball glove, said palm member comprising:

a thumb portion and a plurality of finger portions, and a web portion positioned between said thumb portion and said plurality of finger portions, wherein central lines of all said finger portions cross on said ball-receiving surface, a central line of said thumb portion crosses the central lines of all said finger portions on said ball-receiving surface, and the central line of the thumb portion and the central line of an index finger portion cross at an angle ranging from 85°–105°.

10. The palm member according to claim 9, wherein the central lines of said thumb portion crosses the central lines of said finger portions at a single point on said ball receiving surface.

11. The palm member according to claim 9, wherein the central lines of said finger portions cross in the vicinity of the center of said ball receiving surface and the central line of said thumb portion crosses the central lines of said finger portions in the vicinity of the center of said ball receiving surface.

* * * * *